US005675998A

United States Patent [19]

Monteiro

[11] Patent Number: 5,675,998

[45] Date of Patent: Oct. 14, 1997

[54] THEFT DETERRENT LOCKING DEVICE

[76] Inventor: Luciano T. S. Monteiro, Rua Maranhao, 680 Apt8 121, Santa Paula 09541-001-3.C.Sul-SP, Brazil

[21] Appl. No.: 471,357

[22] Filed: Jun. 6, 1995

[51] Int. Cl.[6] ..... E05B 73/00

[52] U.S. Cl. ..... 70/18; 70/58; 70/164; 70/422

[58] Field of Search ..... 70/14, 15, 18, 70/57.1, 58, DIG. 49, 422, 30, 49, 57, 1.5, 1.7, 158, 163, 164, 166, 167

[56] References Cited

U.S. PATENT DOCUMENTS

| | | | |
|---|---|---|---|
| 4,057,986 | 11/1977 | Zolke et al. | 70/18 X |
| 4,065,946 | 1/1978 | Loynes et al. | 70/58 |
| 4,590,461 | 5/1986 | Cooper | 70/57.1 X |
| 4,676,080 | 6/1987 | Schwarz | 70/59 |
| 4,794,587 | 12/1988 | Cordiano | 70/58 X |
| 4,933,663 | 6/1990 | Holzhauer et al. | 340/568 |
| 4,986,457 | 1/1991 | Faris | 70/58 X |
| 5,003,292 | 3/1991 | Harding et al. | 340/568 |
| 5,154,456 | 10/1992 | Moore et al. | 70/58 X |
| 5,228,319 | 7/1993 | Holley et al. | 70/58 |
| 5,291,761 | 3/1994 | Lii | 70/18 |
| 5,406,809 | 4/1995 | Igelmund | 70/58 X |
| 5,446,618 | 8/1995 | Tetsuya et al. | 70/58 X |
| 5,447,045 | 9/1995 | Cheng | 70/58 |
| 5,526,226 | 6/1996 | Katoh et al. | 361/680 |

FOREIGN PATENT DOCUMENTS

| | | | |
|---|---|---|---|
| 2109109 | 5/1983 | United Kingdom | 70/15 |

*Primary Examiner*—Lloyd A. Gall
*Attorney, Agent, or Firm*—Cushman, Darby & Cushman IP Group of Pillsbury Madison & Sutro LLP

[57] ABSTRACT

A locking device for locking an article to an external structure is provided. The locking device deters theft of the article by being structured so as to cause significant damage to the article, preferably to the point of inoperability, if the article is pulled or jerked away from the external structure. In general, a locking member is threaded, for example, through an opening provided in a critical operating component of the article (such as a circuit board). The opening in the critical operating component is preferably surrounded at its periphery by wiring or other elements which contribute to the operability of the article. The locking member extends to an exterior of the article housing and is secured to an external structure. If the article is pulled or jerked, the locking member generally rips through the circuit board and the wiring thereon, for example, thereby causing significant functional damage to the article and preferably rendering the article inoperative. In other arrangements, outwardly visible damage to the housing can be caused, thereby creating a visual signal suggesting that the article was forcibly, and, therefore, potentially unlawfully removed.

13 Claims, 3 Drawing Sheets

THEFT DETERRENT LOCKING DEVICE

BACKGROUND OF THE INVENTION

1. Field of the Invention

The present invention relates to a locking device for locking an article to an external structure. The locking device deters theft by being structured to damage (and, preferably, disable) the article if the article is pulled or jerked away from the external structure without disengaging the locking device. The present invention is particularly directed to an article having an external housing having operating components housed therein.

2. Description of related art

Certain devices and methods are known for deterring the theft of articles.

In the retail garment industry, for example, it is known to attach a package including a breakable vial of indelible dye to articles of clothing which are on display for consumers. The dye package must be unlocked by the retailer in order to remove it from the article of clothing. However, if the article of clothing is stolen, and the dye package is forcibly removed, then the breakable vial is usually broken, thereby permanently staining the article of clothing and destroying its wearability. This system, however, does not contemplate physically securing the article to an external structure.

In U.S. Pat. No. 4,676,080 of Schwarz, a locking article for securing a cycling accessory, such as a helmet, is disclosed. Schwarz discloses threading a cable loop having a washer or other stop at one end through a vent hole in a bicycle helmet and then threading a standard bicycle lock through the loop in a usual locking configuration. The stop is described as being too large to pass through the hole without permanently distorting either the stop or the hole.

However, even if the hole in the helmet is distorted by pulling the stop through the hole, the helmet's appearance may still be sufficiently unimpaired so as to permit continued use. In addition, the helmet's functional usefulness may not be destroyed assuredly. Therefore, the theft deterrent value of the Schwarz device may not be consistent.

U.S. Pat. No. 5,003,292 of Harding et al. teaches an anti-theft security system which uses a fiber optic coupler mounted to an article to be detected. The coupler is connected via an optical fiber to a light emitter on one side, and via another optical fiber to a light detector. The coupler holds respective ends of the optical fibers in optical alignment with one another. Unauthorized removal of the coupler from the article interrupts the optic path by causing misalignment, thereby triggering an alarm. This system is relative complex, and requires complex and, accordingly, more expensive, equipment. Also, the Harding et al. system is not intended to secure an article physically, nor does it cause damage to the article if the article is in fact stolen. The Harding et al. device is merely an alarm system.

U.S. Pat. No. 4,065,946 of Loynes et al. and U.S. Pat. No. 4,933,663 of Holzhauer et al. both teach anti-theft attachment structures, but neither contemplates causing damage to the attached article as a means for deterring theft thereof.

SUMMARY OF THE INVENTION

It is virtually axiomatic that the would-be thief is attracted to that which is easy to steal, and shuns that which is difficult or time-consuming to steal. In addition, the would-be thief usually desires to gain some value from a stolen article, whether through personal use, or more commonly, through selling or trading the stolen article for some form of profit.

The present invention therefore provides a simple and reliable theft deterrent locking device for locking an article to an external structure, in which the article is damaged if the article is pulled or jerked away from the external structure without properly disengaging the locking device. In particular, the locking device preferably threadedly cooperates with one or more operating components of the article. The damage caused by jerking the article away from the external structure damages the article, preferably rendering the article inoperative and, therefore, essentially worthless. In addition, the locking device is relatively difficult for a would-be thief to disengage so as to avoid damaging the article. This makes stealing the article time-consuming, which further deters thievery.

The foregoing is accomplished in a first embodiment by threading a locking member, (such as, for example, a cable), through a hole formed in a critical operating member of the article, such as a printed circuit board. The locking member extends through a housing of the article, and is then threadedly secured to an external structure. The locking member may be either permanently secured to the external structure or may be releasably (for example, key-locked) secured thereto. With the example of the printed circuit board, the hole provided therein is preferably located in a position such that it is surrounded by circuit components mounted thereon and/or interconnecting wiring. Thus, if the article is pulled or jerked away from the external structure, then the locking member is pulled or ripped through an adjacent periphery of the printed circuit board, thereby breaking wiring and disconnecting or breaking mounted circuit components. In the alternative, if the locking member is somehow retained within the hole without damage immediately adjacent thereto, then the printed circuit board is impulsively jerked relative to other components within the housing, thereby severing wiring connections and the like. In either case, therefore, the device is assuredly rendered damaged or inoperative by the resultant damage, thereby providing significant deterrence to theft.

In another embodiment of the present invention, the locking member is a rigid member, such as a metal rod, which can be inserted through an external structure (such as a mounting arm), the external housing, and a critical operating component of the article. The end of the rigid member may be, for example, adapted to be key-locked to the external structure so that the rigid member can be removed so that, in turn, the article can be dismounted. Thus, the rigid member provides the same function of causing disabling damage to the article should the article be jerked away from the external structure. However, it offers the additional advantage of being easily disengageable from the article when, for example, the correct key is used to unlock the rigid member.

Other objects, features, and characteristics of the present invention, as well as methods of operation and function of the related elements of structure, and the combination of parts and economies of manufacture, will become more apparent upon consideration of the following detailed description and the appended claims with reference to the accompanying drawings, all of which form a part of this specification.

BRIEF DESCRIPTION OF THE DRAWINGS

It is emphasized that the accompanying figures merely illustrate examples of the present invention and should not be construed to limit the scope of the invention.

DETAILED DESCRIPTION OF PREFERRED EMBODIMENTS

The present invention is particularly, although not exclusively, suited for articles having critical operating components such as circuit boards or wiring bundles disposed within an external housing, such as audio or video components (especially car audio components), computer hardware, office electronics, and other electronic equipment.

Figure 1:
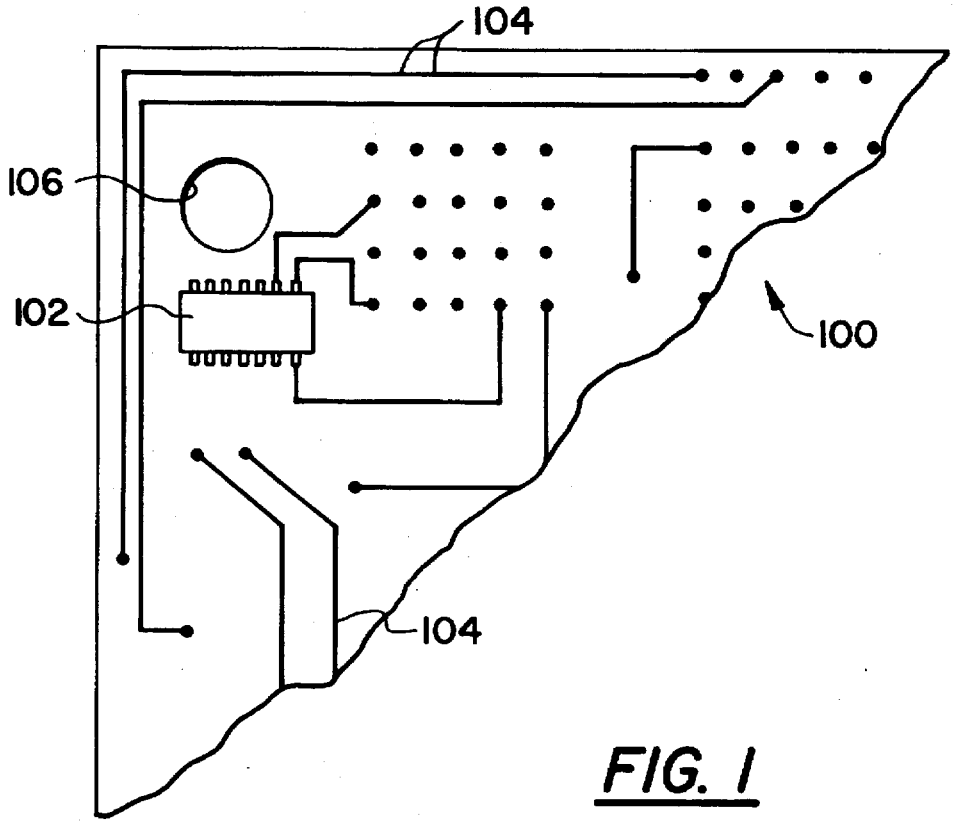
FIG. 1 is a partial plan view illustrating an example of a printed circuit board provided with a hole for receiving a locking member of the present invention.

FIG. 1 shows a portion of a printed circuit board as an example of a critical operating component, according to the present invention.

In FIG. 1, circuit board 100 is provided with, for example, a semiconductor chip package 102 and interconnection wiring 104 for interconnecting the chip package 102 and for providing other needed wiring interconnections. According to the present invention, circuit board 100 is provided with at least one hole 106 formed therethrough for receiving the locking member of the present invention (described below). An important aspect of the present invention is that hole 106 should be substantially surrounded by the other electronic elements of circuit board 100, so that if the locking member is pulled or ripped through the edge of the hole 106 to the edge of the circuit board 100, the elements on the circuit board 100 are assuredly and disablingly damaged. This can be accomplished, for example, by providing the wiring 104 between a periphery of the hole 106 and an edge of the circuit board 100, as seen in FIG. 1. Hole 106 could also be provided in the midst of a plurality of chip packages 102 so that the chip packages 102 would be damaged or separated from the circuit board 100 if the locking member is pulled through the edge of the hole 106.

Figure 2:
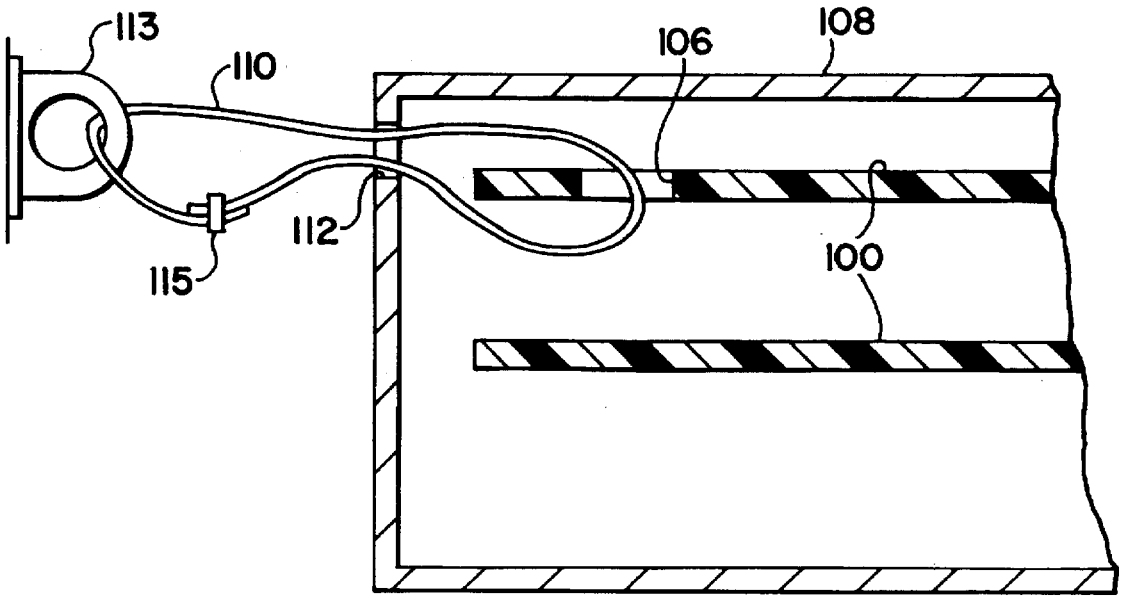
FIG. 2 is a partial cross-sectional view of an article secured by a locking member according to a first embodiment of the present invention.

As seen in FIG. 2, circuit boards 100 are provided in a housing 108. For simplicity, additional structure such as speakers, etc. are not shown within the housing 108. Also, representation of the electronic elements, such as wiring, on circuit boards 100 is omitted for clarity.

According to the first embodiment of the present invention, a braided cable 110 or the like, is threaded through hole 106 in circuit board 100. The braided cable may be made from, for example, braided metal wire. A rigid member may be used instead of the cable 110, where appropriate. The ends of cable 110 are then communicated with an exterior of housing 108 through an opening 112 provided in a sidewall thereof. The cable 110 is then engaged with an external structure such as, for example, a desk top, via an eyebolt 113 or the like. If a cable is used as the locking member, then the ends of the cable may be permanently fixed to each other with, for example, a crimp fastener 115 or by welding to permanently secure the article to the external fixture. Alternatively, the ends of the cable may be releasably locked together with a padlock or other known releasable device. The cable 110 is preferably electrically insulated to avoid interfering with normal operation of the circuit board 100.

Figure 3:
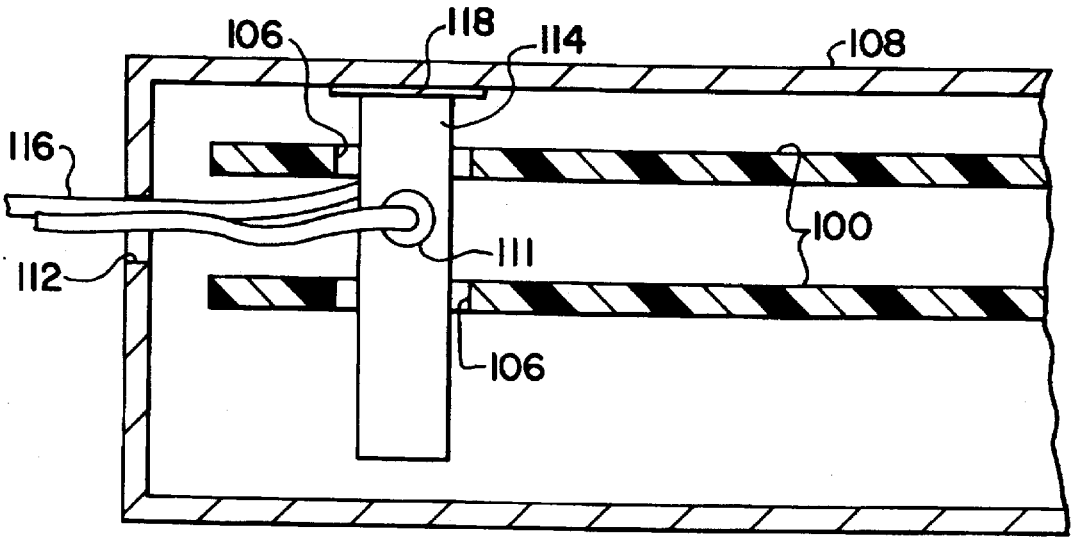
FIG. 3 is a cross-sectional view of an article secured by a locking member according to a variation of the first embodiment of the present invention.

In a variation of the first embodiment, illustrated in FIG. 3, the present invention also includes a rigid (preferably metallic) member or rod 114 which extends through at least one circuit board 100 via a respective hole 106 formed therein. The rigid member 114 threadedly receives, for example, a cable 116 via hole 111 formed in the rigid member 114. The cable 116 extends to an exterior of housing 108, and is secured to an external structure (detail not shown) as described with reference to the first embodiment. The rigid member 114 is also preferably electrically insulated. The rigid member 114 may or may not be physically attached to an interior of housing 108, depending on particular interrelationship of parts. Rigid member 114 is preferably not attached, or loosely or weakly attached (by solder or a known, relatively weak adhesive, for example) to an interior of housing 108 so that rigid member 114 can be assuredly pulled "through" circuit board(s) 100 relative to the housing 108, instead of being undesirably held at the position illustrated in FIG. 3. FIG. 3, for example, shows rigid member being attached to an interior of the housing 108 with, for example, a "breakaway" adhesive connection 118. The adhesive 118 or other attachment method is used only to maintain the position of the rigid member 114 in normal operation.

Figure 4:
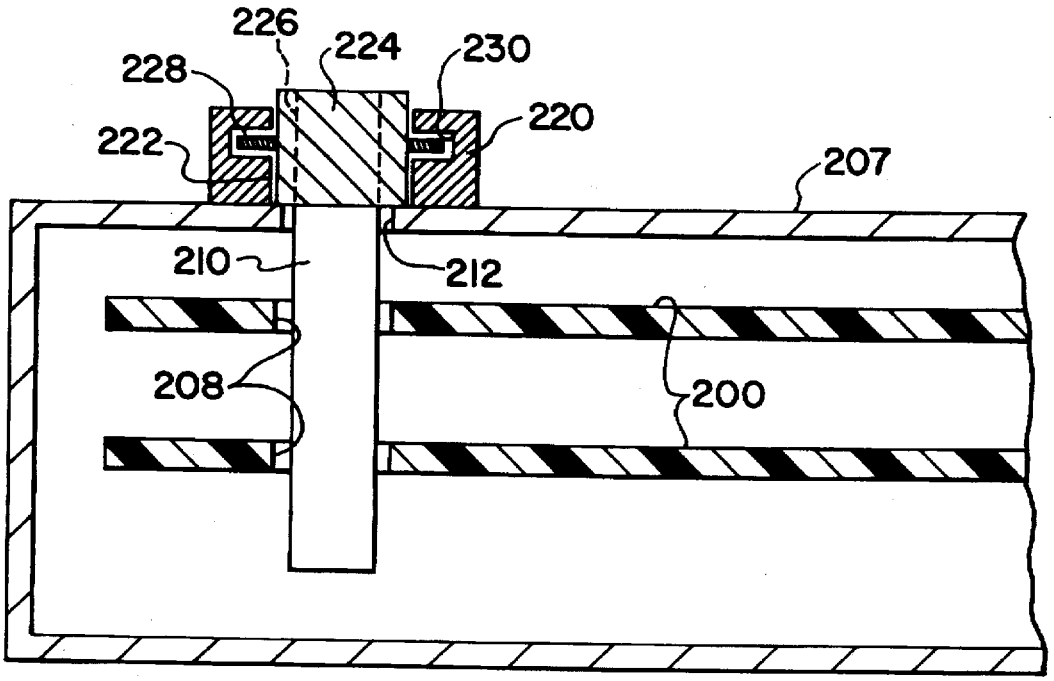
FIG. 4 is a cross-sectional view of an article secured by a locking member according to a second embodiment of the present invention.

In another embodiment of the present invention, as seen in FIG. 4, a rigid, elongate member 210, such as a metal rod, is inserted through an opening 222 provided in an article mounting member 220, an opening 212 provided in housing 209, and a hole 208 formed in at least one circuit board 200. The circuit board(s) 200 have a structure similar to that shown in FIG. 1, including the placement of hole 208 formed therethrough. Openings 222, 212, and 208 are necessarily provided in substantial alignment with one another so that rigid member 210 can be inserted therethrough.

Rigid member 210 is made from any suitably strong material, especially metal or metal alloys, and preferably is made from a material which is resistant to shearing failure.

Rigid member 210 may be adapted to be locked to the mounting member 220. For example, the rigid member 210 may have a locking head 224 with, for example, a key cylinder 226 therein which turns a locking tab 228. The locking tab 228 can in turn engage a slot 230 provided in the mounting member 220.

The present invention according to the above-described second embodiment operates in generally the same manner as in the first embodiment. When the housing 207 is jerked or pulled in an attempt to separate the housing 207 from mounting member 220, the arrangement according to the second embodiment initially acts to resist such movement. However, if relative movement is eventually effected between the housing 207 and the mounting member 220, then the rigid member 210 essentially rips through the circuit board(s) 200 and the housing 207. The damage to the housing 207 is readily visible so as to suggest visibly that the article was forcibly, and therefore possibly unlawfully removed. In addition, the resultant damage to the circuit board(s) 200 is usually sufficient to render the article inoperative.

The embodiment of the present invention illustrated in FIG. 4 may supplement the mechanical connection between the housing 207 and the mounting member 220, but it is generally not intended to provide the primary connection therebetween. Other connection methods such as bolts or welding (not illustrated) are typically used therefor.

Figure 5:
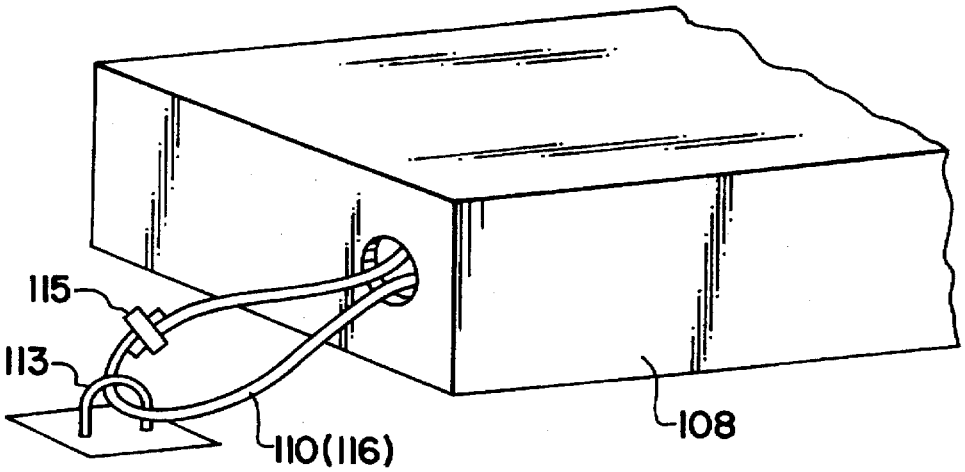
FIG. 5 is a perspective view showing the article according to the first embodiment of the present invention.

FIG. 5 is a simplified, partial perspective view of an article secured according to the embodiments of the present invention illustrated in FIGS. 2 and 3.

Figure 6:
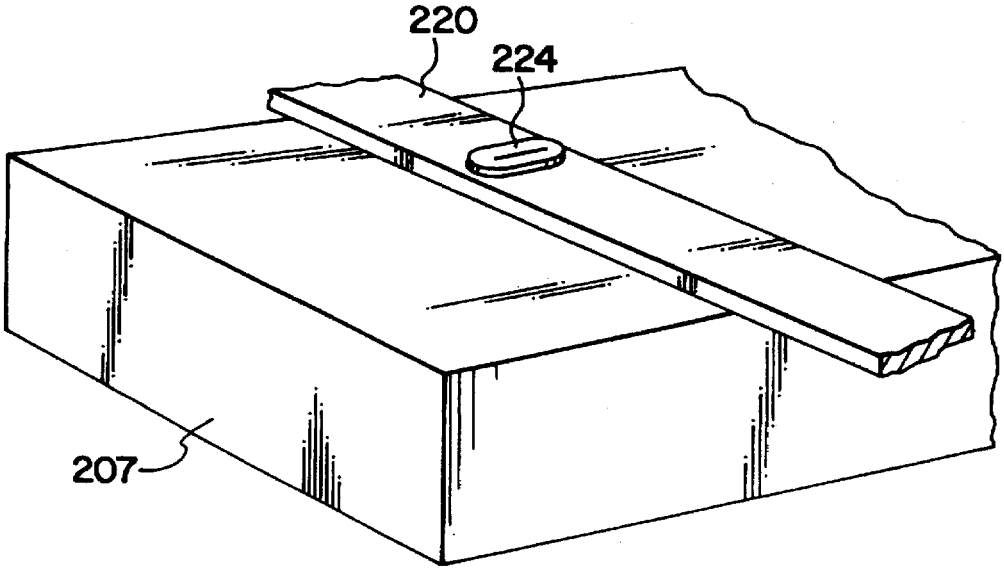
FIG. 6 is a perspective view showing the article according to the second embodiment of the present invention.

FIG. 6 is a simplified, partial perspective view of an article secured according to the embodiment of the present invention illustrated in FIG. 4.

According to the present invention more than one circuit board or similar operating component may be secured by the above-described arrangements. In addition, more than one locking arrangement may be used at different parts of an article in order to secure the device more assuredly.

Many other arrangements employing basic concepts of the present invention may be realized. For example, in another embodiment (not illustrated), a locking member, such as a cable, can be secured around a wire bundle within the article housing, whereby pulling or jerking the article away from the external structure causes the locking member to pull the wiring bundle, thereby breaking multiple wiring connections.

An important feature of theft deterrence is to deter the would-be thief from even attempting to steal the article. It may be desirable, therefore, to post visible notices or the like to inform the would-be thief that the article will be damaged and rendered inoperative if theft is attempted.

It is noted that the manner in which the locking device is secured to an external structure, while not extensively described here, generally should be of a type, whether well-known or not, that is relatively time-consuming to overcome by unlawful methods. This deters all but the most-dedicated thieves, because most thieves prefer to target articles which can be easily, and therefore quickly, taken, so as to reduce the chance of being caught in the act of thievery.

According to the present invention, at least a portion of the operating component at the periphery of the opening formed therethrough is preferably made from a material which fractures or fails at a lower given applied force compared with the material from which the locking member inserted therethrough is made.

While the invention has been described in connection with what is presently considered to be the most practical and preferable embodiments, it is to be understood that the invention is certainly not limited to these disclosed embodiments, but, on the contrary, is intended to cover various modifications and equivalent arrangements included within the spirit and scope of the appended claims.

What I claim is:

1. A theft deterrent device for locking an electronic device to an external fixture, comprising:

an electronic device having a housing having a first opening and at least one electronic operating component provided within the housing, the at least one electronic operating component having a second opening formed therethrough and being provided with at least one electronic operating element located substantially between the first and second openings, and a locking member threadedly insertable through said second opening in the at least one electronic operating component, said locking member being threadable through the first opening provided in the housing so as to communicate with an exterior of the housing for locking with an external fixture such that when sufficient relative movement is effected between said housing and said external fixture, said locking member will cause breakage of said at least one electronic operating component at said second opening to disable the at least one electronic operating element.

2. A theft deterrent device as claimed in claim 1, wherein said locking member is a cable member.

3. A theft deterrent device as claimed in claim 1, wherein said locking member comprises:

a rigid and elongate first member threadedly insertable in the second opening in the at least one electronic operating component; and a second member connected to the first member and threadedly insertable through the first opening provided in the housing so as to be engageable with the external fixture.

4. A theft deterrent device as claimed in claim 1, wherein said locking member is permanently engageable with the external fixture.

5. A theft deterrent device as claimed in claim 1, wherein said locking member is releasably engageable with the external fixture.

6. A theft deterrent device as claimed in claim 1, wherein at least a portion of the electronic operating component adjacent the second opening is formed from a first material, and said locking member is made from a second material, wherein said first material can be fractured with less applied force than said second material.

7. In combination, an electronic device having a housing and at least one electronic operating component provided therein, said at least one electronic operating component including at least one electronic operating element, wherein said housing has a first opening formed therein for communicating an exterior and an interior thereof, wherein said at least one electronic operating component has a second opening provided therethrough and includes said at least one electronic operating element disposed between said first opening and said second opening;

an external fixture; and a locking member threaded through said second opening in said at least one electronic operating component and further threaded through said first opening provided in said housing so as to extend to an exterior of said housing, wherein said locking member is engaged with said external fixture such that when sufficient relative movement is effected between said housing and said external fixture, said locking member will cause breakage of said at least one electronic operating component at said second opening to disable the at least one electronic operating element.

8. A combination as claimed in claim 7, wherein said at least one electronic operating component is a circuit board having electronic elements provided, thereon, wherein said circuit board has said opening provided therethrough at a position where said opening is at least partially surrounded by said electronic elements.

9. In combination with an electronic device having a housing and at least one electronic operating component disposed within the housing, the housing and the at least one electronic operating component each having a respective hole formed therethrough, a theft deterrent device comprising:

a rigid and elongate first member positionable within the housing so as to extend through the hole formed in the at least one electronic operating component, wherein the at least one electronic operating component includes at least one electronic element disposed between the hole formed in the at least one electronic operating component and the hole formed in the housing;

a second member connected to said first member and positionable so as to extend through the hole formed in the housing; and an external fixture, said second member being further connected to said external fixture such that when sufficient relative movement is effected between said housing and said external fixture, said second member will cause movement of said first member which in turn causes breakage of said at least one electronic operating component at said hole thereof to disable the at least one electronic element.

10. A combination as claimed in claim 9, wherein said first member is detachably connectable to an interior of the housing so as to maintain the position of the first member.

11. A combination as claimed in claim 9, wherein said second member is a cable member.

12. A combination as claimed in claim 11, wherein said cable member has respective free ends which are fixed together.

13. A combination as claimed in claim 12, wherein said free ends of said cable member are crimped together with a clip.

* * * * *